United States Patent [19]

Fenske et al.

[11] Patent Number: 4,834,361

[45] Date of Patent: May 30, 1989

[54] VANE WHEEL LAYING OUT DEVICE FOR PRINTING PRODUCTS

[75] Inventors: Horst Fenske, Leipzig; Klaus Hertrich, Göhrenz; Helmut Schumann, Leipzig; Rudolf Störr, Karl-Marx-Stadt, all of German Democratic Rep.

[73] Assignee: Veb Kombinat Polygraph "Werner Lamberz" Leipzig, Leipzig, German Democratic Rep.

[21] Appl. No.: 222,125

[22] Filed: Jul. 20, 1988

[30] Foreign Application Priority Data

Sep. 4, 1987 [DD] German Democratic Rep. ..... 3066565

[51] Int. Cl.[4] ..... B65H 29/00

[52] U.S. Cl. ..... 271/187; 271/195; 271/309; 271/315

[58] Field of Search ..... 101/238, 239, 240, 241, 101/233; 271/187, 315, 195, 309, 900; 270/45, 58

[56] References Cited

U.S. PATENT DOCUMENTS

| | | | |
|---|---|---|---|
| 2,138,178 | 11/1938 | Lang | 271/195 |
| 4,126,948 | 11/1978 | Vermehren | 271/187 |
| 4,145,038 | 3/1979 | Mol | 270/58 |
| 4,244,565 | 1/1981 | Geier | 271/187 |
| 4,466,605 | 8/1984 | Leuthold et al. | 271/195 |
| 4,580,770 | 4/1986 | Warden et al. | 270/58 |
| 4,629,174 | 12/1986 | Wakisaka et al. | 271/187 |
| 4,688,481 | 8/1987 | Cargill | 101/233 |
| 4,708,333 | 11/1987 | Servi et al. | 270/45 |

FOREIGN PATENT DOCUMENTS

| | | | |
|---|---|---|---|
| 1561054 | 5/1973 | Fed. Rep. of Germany . | |
| 2541502 | 6/1978 | Fed. Rep. of Germany . | |
| 3515328 | 4/1987 | Fed. Rep. of Germany . | |
| 0221036 | 10/1986 | Japan | 271/187 |

*Primary Examiner*—Eugene H. Eickholt

*Attorney, Agent, or Firm*—Michael J. Striker

[57] ABSTRACT

A vane wheel laying out unit for sheet-by-sheet laying out of printing products for high speed roller rotary printing machines comprises a vane wheel including a shaft and a plurality of thin vane star discs fixedly mounted on the shaft in a lamellar fashion at a distance from one another, a band supply unit associated with the vane wheel for supplying printing products to the latter, a plurality of stationary blowing air nozzles each associated with a respective one of the vane star discs of the vane wheel so that a direction and an intensity of blowing air stream from the blowing air nozzles influence a friction between a printing product falling in one vane and an outer side of another vane which is arranged after the one vane, the vane star discs, the band supply unit and the blowing air nozzles are arranged in their position relative to one another so that the printing product before an ejection of its rear edge from the band supply unit is blockable by the one vane which receives the printing product from the blowing air streams of the blowing air nozzles, during ejection of its rear edge approximately one half of its length is received in the one vane and after ejection of its rear edge it is braked by the blowing air streams of the blowing air nozzles, a stripper associated with the vane star discs of the vane wheel and formed as a rack adjustably engageable in intermediate spaces between the vane star discs, and a pressure air conduit supplying the blowing air nozzles with a pressure which it controllable in dependence of a machine speed, the vane star discs having a shape which is optimal for braking during receiving the printing product in the vane star discs and during acceleration of the printing product during stripping off by the stripper.

11 Claims, 2 Drawing Sheets

VANE WHEEL LAYING OUT DEVICE FOR PRINTING PRODUCTS

BACKGROUND OF THE INVENTION

The present invention relates to a vane wheel laying out device for sheet-by-sheet laying out of printing products for a high speed roller rotary printing press. More particularly it relates to a vane wheel laying out device for sheet-by-sheet laying out of printing products supplied from a roller rotary printing press to an associated folding apparatus.

Vane wheel laying out devices of this type are known in the art. In known vane wheel laying out devices for sheet-by-sheet laying out of printing products, the printing products fall with a relatively high speed into the vane wheel, they are then abruptly braked, and finally thrown onto the conveyor located under the vane wheel. This not uniform movement course is attributed to the known vane wheel with a wheel hub and vanes on it, and thereby to occurring non-uniform curvature course of the vane profile. As a result of these irregular speed changes, the considerable position deviations of the printing products in the sheet-by-sheet stream toward the conveyor occur.

Furthermore, unstable printing products are subjected to bending and buckling in an unacceptable manner so that the curled corners can be formed. The position and shaped deviation of the printing products in the sheet-by-sheet stream can lead to accumulation of the stream and to clogging in subsequent working stations, for example in a stacker.

One solution is disclosed in the German document DE-PS No. 15 61 054. It includes a special rotatable cylinder with withdrawable puncturing needles for a front edge of the printing product, and a roller which rotates in an opposite direction and rises through the gap in the cylinder casing from the cylinder casing surface for the rear edge of the printing product, so that in cooperation with a rotatable strip the speed of the printing product is slowed and the printing product is stretched. This solution is characterized by considerable expenses for the drive of the roller supported by the cylinder as well as for the drive control of the puncturing needles.

Another solution is proposed in the German document DE-PS No. 25 41 502. Here the speed of the printing product is reduced by the cooperation of a rotatable roller with a roller which supports a strip, so that the roller and the strip engage the printing product in the region of the rear edge. The expenses for this solution are also significant.

A special disadvantage of the proposed solutions is that they cannot produce a sensitive action on the braking force of the printing product. An adjustment of the braking action to the initial speed of the printing product which is dependent on the machine speed during leaving the band conveyor, or to its kinetic energy during falling into the vane wheel, is not possible.

In accordance with a further solution proposed for example in the German document DE-PS No. 35 15 328 C2, it is additionally found that more or less deformed printing product can be positioned in a proper position onto the conveyor. This solution is however very expensive and in the event of a multiple stream of laying out with several sheet-by-sheet streams flowing in a small distance parallel to one another, it cannot be implemented because of the space requirements.

SUMMARY OF THE INVENTION

Accordingly, it is an object of the present invention to provide a vane wheel laying out device for sheet-by-sheet laying out of printing products which operates in an optimal manner in a whole speed range of webs for insuring the quality of printing products during laying out so that no quality defects or deformation of the printing products and disturbance-free laying out without unacceptable position dissipation of printing products in sheet-by-sheet stream are insured.

It is also an object of the present invention to achieve this by transporting the printing products in the vane wheel and by placing them onto the conveyor with a uniform and almost impact-free braking or acceleration.

In keeping with these objects and with others which will become apparent hereinafter, one feature of the present invention resides, briefly stated, in a device in which a a vane wheel is formed by a shaft and a plurality of vane star discs are arranged in a lamellar manner at a distance from one another fixedly on the shaft, a band supply unit is arranged before and supplies the vane wheel with the printing products, each vane star disc is associated with a blowing air nozzle producing blowing air streams with a direction and an intensity which influence the friction between a printing product which falls in a vane and an outer side of another vane which is located after the product receiving vane, the vane star discs together with the band supply unit and the blowing air nozzles are positioned relative to one another so that the printing product before ejection of its rear edge from the band supply unit is blocked by the receiving vane from the blowing air stream while during ejection of its rear edge approximately one half of its length is received in the vane and after the ejection of its rear edge approximately the second half of its length moves in an action region of blowing air streams, a stripper formed as a rake engages in intermediate spaces between the vane star discs with adjustable engagement depth and direction, the blowing air nozzles are supplied through a common pressure conduit with a pressure adjustable in dependence on the machine speed so that the braking force corresponding to the pressure can be adjusted to the kinetic energy of the printing product which falls into the vane wheel, and the vane star discs have an optimal shape for braking during receiving the printing products and for accelerating during stripping the printing products.

The printing products are supplied to the vane wheel by the band supply unit. Synchronously with the approaching a vane, the ejection of a printing product begins with a transporting speed which is proportional to the machine speed. During the ejection of its rear edge, the printing product is located approximately with half of its length in the receiving vane. During this time the receiving vane blocks the printing product from the blowing air streams. After the ejection of its rear edge, the printing product moves under the action of its kinetic energy further into the vane, and approximately the second half of its length moves in the region of the blowing air streams. The blowing air streams press the printing product against the outer side of the vane which follows the receiving vane. In correspondence with the pressure and the friction value between the printing product and the vane, the further movement of the printing product is braked in a very sensitive manner so that its front edge abuts against the bottom of the vane practically in an impact-free manner, or in other the relative speed between the printing product and the vane during abutment is approximately equal to zero.

Braking of the printing product in the region of the rear edge acts so as to produce stretching which is of significant importance for a position-accurate laying out.

In dependence upon a change in the machine speed and also a change in the transporting speed of the band supply unit, pressure in the pressure air conduit which communicates with all blowing nozzles is controlled so that the friction and the braking are also controlled.

When the printing product which lies in the vane reaches the stripper during the rotation of the vane wheel, it is displaced approximately parallel from a uniform circular movement to a movement path along an engaging line of the stripper in direction to the conveyor which defines a transporting plane located below, to the periphery of the vane wheel. Outside of the vane wheel in the case of relatively short path, the printing product is laid on the conveyor. With optimal adjustment of the engagement depth and direction of the stripper, the stripping movement is an approximately rectilinear uniformly accelerated movement, so that the printing product is stripped off in an approximately impact-free manner.

In accordance with an advantageous embodiment of the invention, the shape of the vane star discs is optimized. The vanes formed by the vane star discs have an outer contour with a curve having a continuously changing curvature with a curvature center point path which extends continuously with an increasing distance in rotary direction about the axis of rotation of the vane wheel. The vane has an inner contour formed by a curve with a substantially rectilinear front part for receiving the printing product in correspondence with its movement path and an inner part located in the inner region of the vane having a curvature corresponding to the curvature of the outer curve. The vane has a depth equal to approximately two thirds the length of the printing product.

In accordance with a further advantageous embodiment of the invention, the stripper has a non-rectilinear engaging line such that in a transition region between the vane wheel and the conveyor an approximately continuous movement course for the printing product is insured.

In accordance with a further advantageous feature of the present invention the conveyor is associated with additional blowing air nozzles each located within two vane star discs. By selecting the direction and intensity of the blowing air streams, the laying out of the printing product is possible without forming a disturbing air cushion.

Still a further advantageous feature of the present invention is provided in that guiding brackets are arranged at the periphery of the vane wheel in a segment between a falling in region and a laying-out region. Driven rollers are further arranged peripherally to movement path in a transition region between the vane wheel and the conveyor and form additional guiding means. They have increasing peripheral speeds so as to adjust the speed of the printing product to the speed of the conveyor.

When the device is designed in accordance with the present invention, further advantages are obtained especially when the vane wheel has a lamellar construction. An especial advantage is that the lamellarily formed vane wheel can meet future requirements of increased number of paper sorts to be treated. Printing products of all existing papers are processed in a safer fashion. The lamellarily formed vane wheel is also characterized by a lower surface-specific loading of the printing products which results in avoiding the quality losses by formation of the printing products which often occur in known vane wheels in the region of the front edges.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
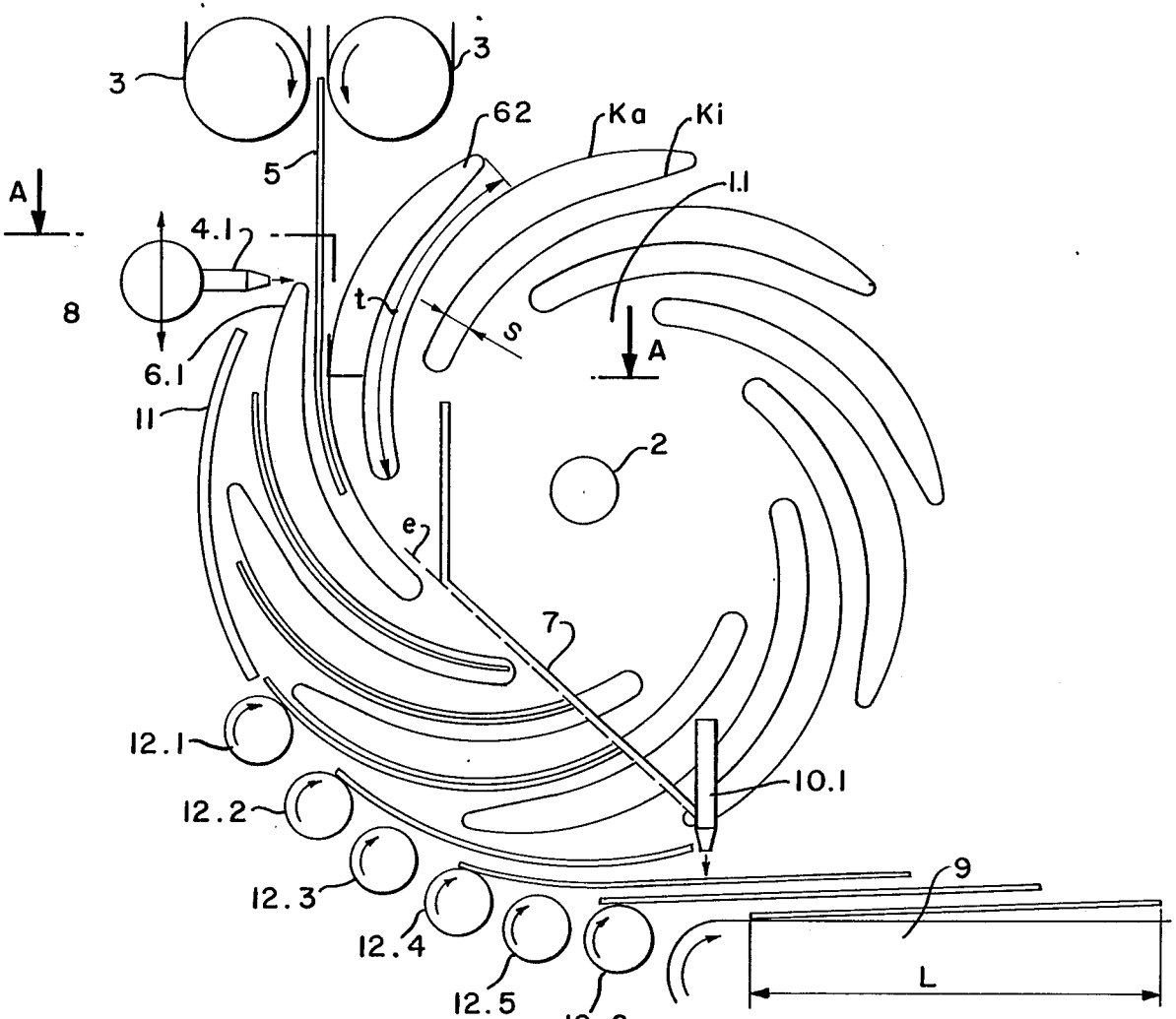
FIG. 1 is a side view showing a vane wheel laying out device in accordance with the present invention.
Figure 2:
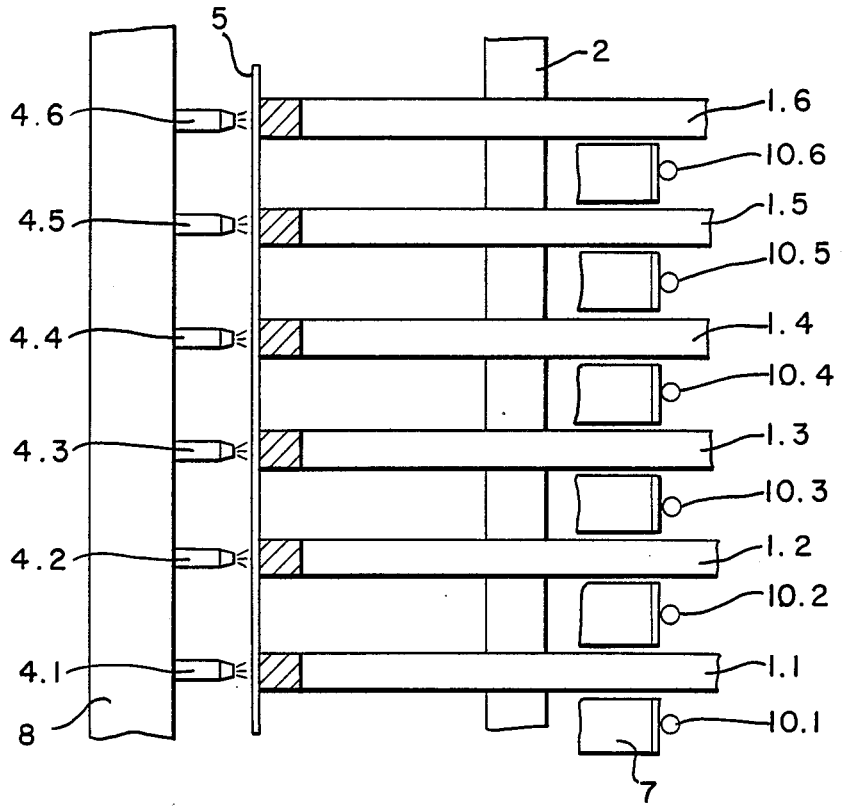
FIG. 2 is a view showing a horizontal partial section through the vane wheel laying out of the present invention.

A vane wheel layout unit in accordance with the present invention has a plurality of vane star discs 1.1 . . . 1.6 each having a thickness which is considerably smaller than a diameter of the disc. The vane star discs are fixedly arranged on a common shaft 2 with distances from one another so as to form a vane wheel. The vane star discs 1.1 . . . 1.6 are for example plastic molded parts. A band supply unit 3 for supplying printing products is associated with the vane wheel.

Blowing air nozzles 4.1 . . . 4.6 are arranged immovably so that each of the blowing air nozzles is associated with a respective one of the vane star discs. The friction between a printing product 5 which falls into a vane and a vane 6.2 which is located after the vane 6.1 receiving the printing product 5 is influenced by the direction and intensity of the blowing air streams. The vane star discs 1.1 . . . 1.6, the band supply unit 3 and the blowing air nozzles 4.1 . . . 4.6 are arranged relative to one another with respect to their relative position so that the printing product 5 before the ejection of its rear edge from the band supply unit 3, is blocked from the blowing air stream by the receiving vane 6.1, during ejection of is rear edge substantially a half of its length L is received by the vane 6.1, and after the ejection of its rear edge approximately the second half of its length L moves in the region of action of the blowing air.

A stripper 7 is associated with the vane star discs 1.1 . . . 1.6. It is formed as a rake and engages into intermediate spaces between the vane star discs 1.1 . . . 1.6. The engagement depth and direction of the stripper 7 are adjustable. The blowing air nozzles 4.1 . . . 4.6 are connected with a pressure air source through a common pressure air conduit 8. The pressure in the pressure air conduit 8 is controllable in dependence on the speed of the machine so that the braking force which correspond to the pressure is adjusted to the kinetic energy of the printing products 4 which fall into the vane wheel.

The shape of the vane star discs 1.1 . . . 1.6 of this embodiment is simplified. As can be seen from FIG. 1, a curve $k_a$ with a constant curvature for example in form of a circular arc is selected as an outer contour for example for the blade 6.2. A curve $k_i$ forms an inner contour of the vane and extends rectinlinearly in an inlet region and along a circular arc in the inner region of the vane. The circular arcs of the inner contour and the outer contour have the same curvature. The depth t of the vane amounts to approximately two-thirds the length L of the printing product 5. The distance s between the vanes, amounts to approximately 3–6 mm.

The printing product 5 is supplied to the vane wheel by the band supply unit 3. Synchronously with the approaching a vane 6.1, the ejection of printing product 5 begins with a transporting speed which is proportional to the machine speed. During the ejection of its rear edge, the printing product 5 is located approximately with half of its length in the receiving vane 6.1. During this movement the receiving vane 6.1 blocks the blowing air streams from the printing product 5. After the ejection of its rear edge, the printing product 5 moves under the action of its kinetic energy further into the vane 6.1, and approximately the second half of its length moves in the region of the blowing air streams. The blowing air streams press the printing product 5 against the outer side of the vane 6.2 which follows the receiving vane 6.1. In correspondence with the pressure and friction values between the printing product and the vane 6.2, the further movement of the printing product is braked in a very sensitive manner, so that its front edge abuts against the bottom of the vane practically in an impact-free manner. The relative speed between the printing product 5 and the vane 6.1 during the abutment is approximately equal to zero.

In dependence upon a change in the machine speed and therefore a connected change in the transporting speed of the band supply unit 3, the pressure in the pressure air conduit 8 and thereby the friction or the braking of the printing product 5 is controlled.

The printing product lies in the vane 6.1 in an undeformed fashion and also in a stretched fashion because of the braking in the region of the rear edge. When this printing product 5 reaches the stripper 7 during rotation of the vane wheel, it is displaced approximately parallel from a smooth circular movement into a movement path along an engaging line e of the stripper 7 in direction of a conveyor 9 which defines a transporting plane, to a peripheral line of the vane wheel.

Outside the vane wheel in case of relatively short path, the printing product 5 is placed onto the conveyor 9. With optimal adjustment of the engagement depth and direction of the stripper 7, the movement of the stripper is approximately a rectilinear smooth accelerated movement so that the printing product 5 is stripped off approximately in an impact-free manner.

A plurality of blowing air nozzles 10.1 . . . 10.5 are associated with the conveyor 9 between each two neighboring vane star discs 1.1 . . . 1.6. By selection of the direction and intensity of the blowing air streams, it is possible to provide placement of the printing product 5 without formation of a disturbing air cushion underneath the product.

Several guide brackets 11 are arranged peripherally to the vane wheel in a sector between the introducing and laying out region. They are located near one another in a relatively close and turnable fashion. The guiding brackets 11 are connected with end switches which in the event of occurrence of clogging between the guiding brackets 11 and the vane wheel produce a control signal.

Driven rollers 12.1 . . . 12.6 are arranged peripherally to the movement path in the transition region between the vane wheel and the conveyor 9. The rotary speed of the rollers 12.1 . . . 12.6 corresponds to a growing arithmetic number sequence and brings the printing product in a very fine fashion to the speed of the conveyor 9.

It will be understood that each of the elements described above, or two or more together, may also find a useful application in other types of constructions differing from the types described above.

While the invention has been illustrated and described as embodied in a vane wheel laying out unit for sheet-by-sheet laying out of printing products for a roller rotary printing press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A vane wheel laying out unit for sheet-by-sheet laying out of printing products for high speed roller rotary printing machines, comprising a vane wheel including a shaft and a plurality of thin vane star discs fixedly mounted on said shaft in a lamellar fashion at a distance from one another; a band supply unit associated with said vane wheel for supplying printing products to the latter; a plurality of stationary blowing air nozzles each associated with a respective one of said vane star discs of said vane wheel so that a direction and an intensity of blowing air streams from said blowing air nozzles influence a friction between a printing product falling in one vane and an outer side of another vane which is arranged after the one vane, said vane star discs, said band supply unit and said blowing air nozzles being arranged in their position relative to one another so that the printing product before an ejection of its rear edge from said band supply unit is blockable by the one vane which receives the printing product from the blowing air streams of said blowing air nozzles, during ejection of its rear edge approximately one half of its length is received in the one vane and after ejection of its rear edge it is braked by the blowing air streams of said blowing air nozzles; a stripper associated with said vane star discs of said vane wheel and formed as a rack adjustably engageable in intermediate spaces between said vane star discs; and a pressure air conduit supplying said blowing air nozzles with a pressure which is controllable in dependence of a machine speed, said vane star discs having a shape which is optimal for braking during receiving the printing product in said vane star discs and during acceleration of the printing product during stripping off by said stripper.

2. A vane wheel laying out device as defined in claim 1, wherein each of said star discs of said vane wheel has a thickness which is significantly smaller than a diameter of the same.

3. A vane wheel laying out device as defined in claim 1, wherein said vane star discs of said vane wheel are formed as plastic molded parts.

4. A vane wheel laying out device as defined in claim 1, wherein each of said vane star discs has a plurality of vanes, each of said vanes having an outer contour which is formed as a curve with a continuously increasing curvature, said curvature having a curvature center point path which continuously proceeds in a rotary direction with an increasing distance about an axis of rotation of said vane wheel.

5. A vane wheel laying out device as defined in claim 4, wherein each of said vanes has an inner contour which is formed by a curve having a rectilinear outer part as considered in direction of receiving the printing product and a curved inner part provided in an inner region of the vane and extending substantially parallel to the curve of said outer contour.

6. A vane wheel laying out device as defined in claim 5, wherein each of said vanes has a depth which substantially corresponds to two-thirds of a length of the printing product.

7. A vane wheel laying out device as defined in claim 1; and further comprising a conveyor arranged subsequently to said vane wheel, said stripper having a non-rectilinear engaging line such that in a transition region between said vane star discs of said vane wheel and said conveyor an approximately uniform movement course for the printing product is obtained.

8. A vane wheel laying out device as defined in claim 1; and further comprising a conveyor arranged subsequently to said vane wheel; and further comprising a plurality of further blowing air nozzles each associated with said conveyor and located between two of said vane star discs so as to produce further blow air streams whose direction and intensity contributes to laying out of the printing products on said conveyor without forming air cushions.

9. A vane wheel laying out device as defined in claim 1; and further comprising a plurality of guiding brackets arranged closely to one another and in a turnable fashion at a periphery of said vane star discs of said vane wheel and in a sector between a receiving region and a laying out region.

10. A vane wheel laying out device as defined in claim 9; and further comprising end switches connected with said guiding brackets and formed for producing a control signal in the event of occurrence of clogging between said guiding brackets and said vane wheel.

11. A vane wheel laying out device as defined in claim 1; and further comprising a conveyor arranged subsequently to said vane star discs of said vane wheel; and a plurality of driven rollers arranged peripherally relative to a movement path of the printing products in a transition region between said vane star discs and said conveyor so that by changing a rotary speed of said rollers a speed of the printing product can be adjusted to a speed of said conveyor.

* * * * *